US012116684B2

(12) United States Patent
Tripathy

(10) Patent No.: US 12,116,684 B2
(45) Date of Patent: Oct. 15, 2024

(54) METHODS OF FORMING ALLOYS BY REDUCING METAL OXIDES

(71) Applicant: Battelle Energy Alliance, LLC, Idaho Falls, ID (US)

(72) Inventor: Prabhat K. Tripathy, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 472 days.

(21) Appl. No.: 16/388,272

(22) Filed: Apr. 18, 2019

(65) Prior Publication Data

US 2019/0323135 A1 Oct. 24, 2019

Related U.S. Application Data

(60) Provisional application No. 62/661,881, filed on Apr. 24, 2018.

(51) Int. Cl.

| | |
|---|---|
| ***C25C 1/24*** | (2006.01) |
| ***C25C 1/08*** | (2006.01) |
| ***C25C 3/36*** | (2006.01) |
| ***C25C 5/04*** | (2006.01) |
| ***C25C 7/02*** | (2006.01) |

(52) U.S. Cl.

CPC ..... *C25C 5/04* (2013.01); *C25C 7/025* (2013.01)

(58) Field of Classification Search

CPC .... C25C 3/34; C25C 3/00; C25C 3/36; C25C 7/005; C25C 7/00; C25C 7/06; C25C 1/00; C25C 5/04

See application file for complete search history.

(56) References Cited

U.S. PATENT DOCUMENTS

| | | | |
|---|---|---|---|
| 3,592,639 | A | 7/1971 | Schussler et al. |
| 3,711,385 | A | 1/1973 | Beer |
| 3,890,244 | A | 6/1975 | Carlin |
| 3,897,265 | A | 7/1975 | Auborn |
| 4,007,107 | A | 2/1977 | Johnson |
| 4,075,042 | A | 2/1978 | Das |
| 4,187,155 | A | 2/1980 | De et al. |
| 4,225,395 | A | 9/1980 | Tsang |
| 4,298,437 | A | 11/1981 | Hard |

(Continued)

FOREIGN PATENT DOCUMENTS

| | | | |
|---|---|---|---|
| EP | 2322693 | B1 | 10/2017 |
| GB | 2570700 | A | 7/2019 |

(Continued)

OTHER PUBLICATIONS

Arpin, K.A., et al., "Electrodeposited 3D Tungsten Photonic Crystals with Enhanced Thermal Stability," Chemistry of Materials, vol. 23, Oct. 18, 2011, pp. 4783-4788.

(Continued)

*Primary Examiner* — Zulmariam Mendez
(74) *Attorney, Agent, or Firm* — TraskBritt

(57) ABSTRACT

A method of forming an alloy includes disposing a first metal oxide and a second metal oxide in a molten salt. The molten salt is in contact with a working electrode and a counter electrode. An electrical potential is applied between the counter electrode and the working electrode to co-reduce the first metal oxide and the second metal oxide to form a first metal and a second metal, respectively.

20 Claims, 2 Drawing Sheets

(56) References Cited

U.S. PATENT DOCUMENTS

| | | | | |
|---|---|---|---|---|
| 4,402,996 | A | 9/1983 | Gauger et al. | |
| 4,582,585 | A * | 4/1986 | Ray | C25C 7/025 204/292 |
| 4,731,169 | A | 3/1988 | Lipsztajn | |
| 5,500,100 | A | 3/1996 | Riley et al. | |
| 5,516,353 | A | 5/1996 | Sahai et al. | |
| 5,868,912 | A | 2/1999 | Reichert et al. | |
| 6,103,090 | A | 8/2000 | De et al. | |
| 6,309,441 | B1 | 10/2001 | Benz et al. | |
| 6,540,902 | B1 | 4/2003 | Redey et al. | |
| 7,090,760 | B2 | 8/2006 | Seo et al. | |
| 7,390,392 | B1 | 6/2008 | Choi et al. | |
| 7,410,561 | B2 | 8/2008 | Dees et al. | |
| 7,510,680 | B2 | 3/2009 | Steibel et al. | |
| 8,049,408 | B2 | 11/2011 | Smith et al. | |
| 8,313,624 | B2 | 11/2012 | Fray et al. | |
| 8,734,738 | B1 | 5/2014 | Herrmann | |
| 9,017,527 | B2 | 4/2015 | Wiedmeyer et al. | |
| 9,034,159 | B2 | 5/2015 | Bar-Or et al. | |
| 9,249,520 | B2 | 2/2016 | Withers et al. | |
| 10,590,553 | B2 | 3/2020 | Mellor et al. | |
| 10,872,705 | B2 | 12/2020 | Tripathy | |
| 2003/0075454 | A1 | 4/2003 | Nora et al. | |
| 2004/0052672 | A1 | 3/2004 | Fray et al. | |
| 2004/0159559 | A1 | 8/2004 | Fray et al. | |
| 2005/0178658 | A1 | 8/2005 | Nguyen et al. | |
| 2007/0280398 | A1 | 12/2007 | Dardik et al. | |
| 2008/0023321 | A1 | 1/2008 | Sadoway | |
| 2008/0110765 | A1 | 5/2008 | Ogasawara et al. | |
| 2010/0282602 | A1 | 11/2010 | Fray et al. | |
| 2012/0160704 | A1 | 6/2012 | Wiedmeyer et al. | |
| 2013/0186769 | A1 | 7/2013 | Powell et al. | |
| 2018/0209057 | A1 | 7/2018 | Tripathy et al. | |
| 2019/0237209 | A1 * | 8/2019 | Tripathy | C25C 7/025 |
| 2020/0063243 | A1 | 2/2020 | Tripathy | |
| 2020/0324336 | A1 | 10/2020 | Tripathy et al. | |
| 2021/0009415 | A1 | 1/2021 | Kamali | |
| 2021/0055248 | A1 | 2/2021 | Tripathy et al. | |
| 2021/0118585 | A1 | 4/2021 | Tripathy | |
| 2021/0189523 | A1 | 6/2021 | Fontaine et al. | |

FOREIGN PATENT DOCUMENTS

| | | | | |
|---|---|---|---|---|
| JP | 62063642 | * | 3/1987 | C22C 28/00 |
| WO | 2005/019501 | A2 | 3/2005 | |
| WO | 2017/158335 | A1 | 9/2017 | |

OTHER PUBLICATIONS

ASME International, "Report of the American Society of Mechalical Engineers' Technical Working Group on Inert Anode Technologies", CRTD—vol. 53, (Jul. 1999) 180 pages.

Balla., V.K., et al., "Direct laser processing of a tantalum coating on titanium for bone replacement structures," Acta Biomaterialia, vol. 6, Issue 6, Jun. 2010, pp. 2329-2334.

Barnett et al., "Reduction of Tantalum Pentoxide Using Graphite and Tin-Oxide-Based Anodes via the FFC-Cambridge Process," The Minerals, Metals & Materials Society and ASM International: Metallurgical and Materials Transactions B, vol. 40B, (2009), pp. 150-157.

Beguin, C., et al., "Tantalum Coating of Mild Steel by Chemical Vapour Deposition," Thin Solid Films, vol. 46, Issue 2, Oct. 1977, pp. 209-212.

Bishop, C.R., et al., "Preventing Hydrogen Embrittlement of Tantalum," Journal of Metals, vol. 13, Feb. 1961, pp. 144-145.

Brown et al., "A Novel Molten-Salt Electrochemical Cell for Investigating the Reduction of Uranium Dioxide to Uranium Metal by Lithium Using in Situ Synchrotron Radiation," J. Synchrotron Rad., vol. 24, (2017), pp. 439-444.

Cardarelli, F., et al., "Tantalum Protective Thin Coating Techniques for the Chemical Process Industry: Molten Salts Electrocoating as a New Alternative," International Journal of Refractory Metals and Hard Materials, vol. 14, Issue 5-6, 1996, pp. 365-381.

Cardonne, S.M., et al., "Tantalum and its Alloys," International Journal of Refractory Metals and Hard Materials, vol. 13, Issue 4, 1995, pp. 187-197, 193-194.

Chang et al, Functional links between stability and reactivity of strontium ruthenate single crystals during oxygen evolution, Nature Communications, vol. 5, Jun. 2014, Article No. 4191 (Year: 2014).

Elwell et al., "Analysis of the New Metals (Titanium, Zirconium, Hafnium, Niobium, Tantalum, Tungsten and Their Alloys)", First Edition, Pergamon, 1966, pp. 228.

Feild, A.L. Jr., et al., "Research and Development of Tantalum- and Tungsten-Base Alloys," Armed Services Technical Information Agency Arlington Hall Station, May 26, 1961, pp. 214.

Freund et al, Single crystal growth from separated educts and its application to lithium transition-metal oxides, Nature Scientific Reports, vol. 6, Oct. 2016, Article No. 35362 (Year: 2016).

Garg, S.P., et al., "The Preparation of Hafnium-Tantalum Alloy by Carbide-Oxide Reaction," Journal of the Less-Common Metals, vol. 50, Issue 2, Dec. 1976, pp. 245-251.

Gibilaro et al., "Direct Electrochemical Reduction of Solid Uranium Oxide in Molten Fluoride Salts," J. Nuclear Materials, vol. 414, (2011), pp. 169-173.

Hermann et al, Comparative study of monolithic platinum and iridium as oxygen-evolving anodes during the electrolytic reduction of uranium oxide in a molten LiCl—Li2O electrolyte, Journal of Applied Electrochemistry, vol. 49, No. 4, Feb. 2019, pp. 379-388 ( Year: 2019).

Holmes. D.R., et al., "Corrosion of Hafnium and Hafnium Alloys," ASM International, vol. 13B, 2005, pp. 6.

Jensen, A.H., et al., "Contact Resistance of Tantalum Coatings in Fuel Cells and Electrolyzers Using Acidic Electrolytes at Elevated Temperatures," ECS Electrochemistry Letters, vol. 3, No. 7, 2014, pp. F50-F51.

Kim et al , Electrolysis of Molten Iron Oxide with an Iridium Anode: The Role of Electrolyte Basicity, Journal of the Electrochemical Society, vol. 158, No. 10, Aug. 2011, pp. E101-E105, (Year: 2011).

Kotz et al, XPS Studies of Oxygen Evolution on Ru and RuO2 Anodes, Journal of the Electrochemical Society, vol. 130, No. 4, Apr. 1983, pp. 825-829, (Year: 1983).

Lantelme, F., et al., "Electrodeposition of Tantalum in NaCl—KCl—K2TaF7 Melts," Journal of the Electrochemical Society, vol. 139, No. 5, May 1992, pp. 1249-1255.

Lee, Y-L., et al., "Molten Salt Multi-Anode Reactive Alloy Coating (MARC) of Ta—W Alloy on SUS316L," The 8th Pacific Rim International Congress on Advanced Materials and Processing, Sep. 2013, pp. 1975-1981.

Li, H., et al., "A Novel Tantalum-Coated Carbon-Carbon Composite Cage for Lumbar Spine Fusion," 51st Annual Meeting of the Orthopaedic Research Society, Poster No. 1322, Nov. 4, 2004, p. 1.

Lin et al., "Ultralow Ruthenium Loading Cobalt-Molybdenum Binary Alloy as Highly Efficient and Super-Stable Electrocatalyst for Water Splitting," Applied Surface Science, vol. 541, (2021), 148518, 12 pages.

Marnoch, K., "High-Temperature Oxidation-Resistant Hafnium-Tantalum Alloys," Journal of Metals, vol. 17, Issue 11, Nov. 1965, pp. 1225-1231.

Mehmood, M., et al., "Electro-Deposition of Tantalum on Tungsten and Nickel in LiF—NaF—CaF2 Melt Containing K2TaF7—Electrochemical Study," Materials Transactions, vol. 44, No. 2, 2003, pp. 259-267.

Park et al, A New Water Oxidation Catalyst: Lithium Manganese Pyrophosphate with Tunable Mn Valency, Journal of the American Chemical Society, vol. 136, No. 11, Feb. 2014, pp. 4201-4211, (Year: 2014).

Perry, A.J., et al., "Tantalum Coating of Mild Steel at Atmospheric Pressure," Thin Solid Films, vol. 66, 1980, pp. 197-210.

Report of the American Society of Mechanical Engineers' Technical Working Group on Inert Anode Technologiee, Under Contact #DE-FC07-98ID13652 to the U.S. Department of Energy Office of Industrial Technologies, CRTD—vol. 53, Jul. 1999, 180 pages.

(56) References Cited

OTHER PUBLICATIONS

Sakakibara, R., et al., "Practical emitters for thermophotovoltaics: a review," Journal of Photonics for Energy, vol. 9, No. 3, Jul.-Sep. 2019, pp. 032713-1-032713-20.

Seitz et al, A highly active and stable IrOx/SrlrO3 catalyst for the oxygen evolution reaction, Science, vol. 353, Issue 6303, Sep. 2016, pp. 1011-1014 (Year: 2016).

Smathers, D.B., et al., "Efficacy of Tantalum Tungsten Alloys for Diffusion Barrier Applications," IOP Conf. Series: Materials Science and Engineering, vol. 279, 2017, pp. 1-6.

Stelmakh, V., et al., "High-temperature tantalum tungsten alloy photonic crystals: Stability, optical properties, and fabrication," Applied Phusics Letters, vol. 103, Sep. 19, 2013, pp. 123903-1-123903-4.

Stelmakh, V., et al., "Sputtered Tantalum Photonic Crystal Coatings for High-Temperature Energy Conversion Applications," in IEEE Transactions on Nanotechnology, vol. 15, No. 2, Mar. 2016, pp. 303-309.

U.S. Appl. No. 17/444,482, filed Aug. 5, 2021, titled "Anodes Comprising Transition Metal and Platinum Group Metal as Alloys, and Related Methods and Systems", to Tripathy, 38 pages.

Yin et al., On the development of metallic inert anode for molten CaCl2—CaO System, Electrochimica Acta, vol. 56, No. 9, Mar. 2011, pp. 3296-3302, (Year: 2011).

Curti et al, Characterization of selenium in UO2 spent nuclear fuel by micro X-ray absorption spectroscopy and its thermodynamic stability, Environmental Science: Processes & Impacts, vol. 17, No. 10, Oct. 2015, pp. 1760-1768 (Year: 2015).

Gorodetskii et al., Titanium Anodes with an Active Coating Based on Iridium Oxides: The Effect of the Coating's Thickness, Porosity, and Morphology on its Stability, Selectivity, and Catalytic Activity; Russian Journal of Electrochemistry; vol. 41; (2005) 8 pages.

Gorodetskij et al., Corrosion-Resistant Iridium Dioxide-Based Anodes; Ehlektrokhimiya; vol. 30; Issue 8; (Aug. 1994) 3 pages.

Hastelloy N Alloy; Haynes International; H-2052D; (2020) 14 pages.

Yagi et al ("Alternating Pulsed Electrolysis for Iron-Chromium Alloy Coatings with Continuous Composition Gradient", 2007 J. Electrochem. Soc. 154 D304). (Year: 2007).

* cited by examiner

METHODS OF FORMING ALLOYS BY REDUCING METAL OXIDES

CROSS-REFERENCE TO RELATED APPLICATION

This application claims the benefit under 35 U.S.C. § 119(e) of U.S. Provisional Patent Application Ser. No. 62/661,881, filed Apr. 24, 2018, the disclosure of which is hereby incorporated herein in its entirety by this reference.

STATEMENT REGARDING FEDERALLY SPONSORED RESEARCH OR DEVELOPMENT

This invention was made with government support under Contract Number DE-AC07-05-ID14517 awarded by the United States Department of Energy. The government has certain rights in the invention.

TECHNICAL FIELD

Embodiments of the present disclosure relate generally to methods of forming alloy powders and reducing metal oxides.

BACKGROUND

Because of their useful properties (e.g., hardness, magnetism, strength, etc.), nickel-cobalt alloys are used in electronics, magnetic sensors, actuators, micro-relays, inductors, marine devices, medical devices, jet engines, high strength aerospace hardware, gas turbines, chemical processing and petroleum refining equipment, etc. Nickel-cobalt alloys may exhibit improved performance characteristics in comparison to commonly used stainless steels. Three-dimensional, complex-shaped components can be formed by high-speed electroplating. However, such processes require high current density.

Such alloys are typically produced by aqueous electrochemical processes. Although cobalt is less noble, it preferentially deposits over nickel, and therefore a nickel-deficient composition is usually the end product of co-electrodeposition of nickel and cobalt. To circumvent this problem, various additives may be included to offset the preferential deposition of cobalt. However, these modifications have not been able to mitigate the problem completely.

Typical permanent magnets are formed of alloyed metals, such as $SmCo_5$ or $Sm_2Co_{17}$. These alloys may be prepared from ingots produced by melting samarium and cobalt in vacuum or in an inert gas atmosphere. Ingots may be pulverized, and the resulting powders pressed in a magnetic field to form green bodies, which are in turn sintered and heat-treated to provide permanent magnets that are magnetically anisotropic (i.e., having a field strength that varies based on direction).

Magnetically anisotropic, resin-bonded samarium-cobalt permanent magnets bay may be formed by injection-molding or compression-mixing a mixture of a resin and samarium-cobalt magnet powder produced from a sintered magnet. Thus, resin-bonded samarium-cobalt magnets can be obtained by preparing sintered magnets having anisotropy, pulverizing them, and then mixing them with resins as binders.

Composite magnets may incorporate nano-sized soft magnetic phases (i.e., materials having a relatively low magnetic coercivity) into a hard magnetic phase (i.e., materials having a relatively high magnetic coercivity, such as permanent magnets). These composite magnets may have a higher energy density than soft magnets and lower costs than permanent magnets due to the use of a lower quantity of rare-earth elements therein.

BRIEF SUMMARY

In some embodiments, a method of forming an alloy includes disposing a first metal oxide and a second metal oxide in a molten salt. The molten salt is in contact with a working electrode and a counter electrode. An electrical potential is applied between the counter electrode and the working electrode to co-reduce the first metal oxide and the second metal oxide to form a first metal and a second metal, respectively.

In certain embodiments, a method of reducing metal oxides includes providing an electrochemical cell comprising a working electrode, a counter electrode comprising a platinum-group metal, and a molten salt in contact with the working electrode and the counter electrode; disposing a material comprising at least two metal oxides in contact with the molten salt and the working electrode; and providing an electric current between the counter electrode and the working electrode to reduce the at least two metal oxides to form an alloy comprising at least two metals formed by reduction of the at least two metal oxides.

DETAILED DESCRIPTION

The illustrations presented herein are not actual views of any particular material, component, or system, but are merely idealized representations that are employed to describe example embodiments of the present disclosure. Additionally, elements common between figures may retain the same numerical designation.

The following description provides specific details, such as material types, dimensions, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional techniques employed in the industry. In addition, the description provided below does not form a complete process flow, apparatus, system, or method for reducing a metal oxide. Only those process acts and structures necessary to understand the embodiments of the disclosure are described in detail below. Additional acts to reduce a metal oxide may be performed by conventional techniques. Also note, the drawings accompanying the present application are for illustrative purposes only, and are thus not drawn to scale. Additionally, elements common between figures may retain the same numerical designation.

As used herein, the term "platinum group metal" (PGM) means and includes a metal material comprising at least one of ruthenium, osmium, rhodium, iridium, palladium, or platinum.

Figure 1:
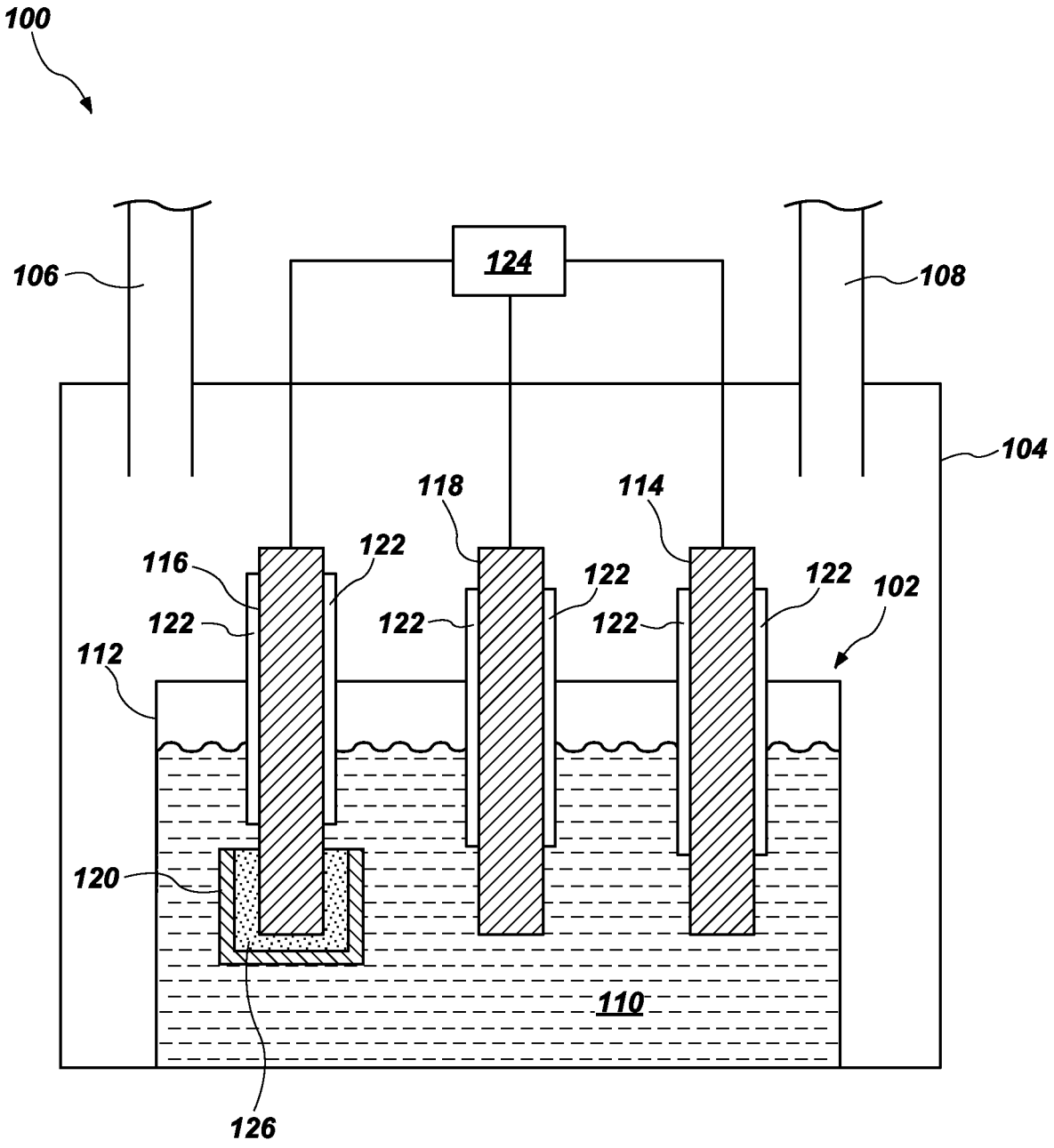
FIG. 1 is a simplified schematic of an electrochemical cell, in accordance with embodiments of the disclosure.

FIG. 1 is a simplified schematic of a system 100 including an electrochemical cell 102 for reducing metal oxides to form an alloy powder. According to embodiments described herein, the electrochemical cell 102 includes a molten salt electrolyte 110, with a counter electrode 114 (e.g., an anode) and a working electrode 116 (e.g., a cathode) in contact with the molten salt electrolyte 110. The molten salt electrolyte 110 may include a molten salt of an alkali metal halide salt, an alkaline earth metal halide salt, an alkali metal oxide, an alkaline earth metal oxide, or combinations thereof. Metal oxides 126 adjacent the working electrode 116 may be reduced in the electrochemical cell 102 when an electrical potential is applied between the working electrode 116 and the counter electrode 114.

The electrochemical cell 102 may include a crucible 112 comprising a metal, glassy carbon, ceramic, a metal alloy, or another material. In some embodiments, the crucible 112 comprises a non-metallic material, such as alumina ($Al_2O_3$), magnesia (MgO), glassy carbon, graphite, boron nitride, another material, or combinations thereof. In other embodiments, the crucible comprises a metal or metal alloy, such as nickel; molybdenum; tantalum; stainless steel; alloys of nickel and copper; alloys of nickel, chromium, iron, and molybdenum; alloys of nickel, iron, and molybdenum; and combinations thereof.

As noted above, molten salt electrolyte 110 may be disposed in the crucible 112, in which at least one counter electrode 114 and at least one working electrode 116 are also located. In some embodiments, the electrochemical cell 102 further includes a reference electrode 118 located in crucible 112 and configured for monitoring a potential in the electrochemical cell 102. In some embodiments, a sheath 122 is disposed around at least a portion of one or more of the counter electrode 114, the working electrode 116, and the reference electrode 118. The sheath 122 may be configured to provide electrical insulation between the respective electrodes and the crucible 112. In some embodiments, the sheath 122 comprises alumina (e.g., an alumina tube), magnesia, mullite, boron nitride, or a combination thereof.

The molten salt electrolyte 110 may include a material formulated and configured to facilitate reduction of the metal oxides 126. In some embodiments, the molten salt electrolyte 110 comprises an alkali halide salt, an alkaline earth metal halide salt, an alkali oxide, an alkaline earth metal oxide, or combinations thereof. By way of nonlimiting example, the molten salt electrolyte 110 may include lithium chloride (LiCl), lithium oxide ($Li_2O$), sodium chloride (NaCl), calcium chloride ($CaCl_2$), calcium oxide (CaO), lithium bromide (LiBr), potassium bromide (KBr), cesium bromide (CsBr), calcium bromide ($CaBr_2$), potassium chloride (KCl), potassium bromide (KBr), strontium chloride ($SrCl_2$), strontium bromide ($SrBr_2$), or a combination thereof.

In some embodiments, the molten salt electrolyte 110 comprises calcium chloride ($CaCl_2$) and calcium oxide (CaO). In some such embodiments, the calcium oxide constitutes between about 0.25 weight percent (wt %) and about 5.0 wt % of the molten salt electrolyte 110, such as between about 0.5 wt % and about 2.0 wt %, or between about 1.5 wt % and about 2.5 wt % of the molten salt electrolyte 110. The calcium chloride may constitute a remainder of the molten salt electrolyte 110. In some embodiments, the calcium oxide constitutes about 1.0 wt % of the molten salt electrolyte 110.

The molten salt electrolyte 110 may be maintained at a temperature such that the molten salt electrolyte 110 is, and remains, in a molten state. In other words, the temperature of the molten salt electrolyte 110 may be maintained at or above a melting temperature of the molten salt electrolyte 110. By way of non-limiting example, if the molten salt electrolyte 110 comprises sodium chloride and calcium chloride, the temperature thereof may be maintained between about 550° C. and about 950° C. The molten salt electrolyte 110 may be maintained at a temperature of at least about 750° C., at least about 850° C., or even at least about 900° C. However, the disclosure is not so limited, and the temperature of the molten salt electrolyte 110 may be different than those described above. The molten salt electrolyte 110 may be at a relatively lower temperature than the temperature of conventional electrolysis processes used to form alloys, which may require operation at temperatures of, for example, 1,200° C.

The counter electrode 114 may include a material that is substantially inert or otherwise not substantially consumed in the electrochemical cell 102. In some embodiments, the counter electrode 114 comprises a material that is stable in an oxidizing atmosphere at an operating temperature of the electrochemical cell 102. In some embodiments, the material of the counter electrode 114 comprises at least one platinum group metal (PGM), at least one precious metal (e.g., gold or silver), or a combination thereof. By way of non-limiting example, the counter electrode 114 is selected from the group consisting of at least one of osmium, ruthenium, rhodium, iridium, palladium, platinum, silver, gold, lithium iridate ($Li_2IrO_3$), lithium ruthenate ($Li_2RuO_3$), a lithium rhodate ($LiRhO_2$, $LiRhO_3$), a lithium tin oxygen compound (e.g., $Li_2SnO_3$), a lithium manganese oxygen compound (e.g., $Li_2MnO_3$), calcium ruthenate ($CaRuO_3$), strontium ruthenium ternary compounds (e.g., $SrRuO_3$, $Sr_2RuO_3$, $Sr_2RuO_4$), $CaIrO_3$, strontium iridate (e.g., $SrIrO_3$, $SrIrO_4$, $Sr_2IrO_4$), calcium platinate ($CaPtO_3$), strontium platinate ($SrPtO_4$), magnesium ruthenate ($MgRuO_4$), magnesium iridate ($MgIrO_4$), sodium ruthenate ($Na_2RuO_4$), sodium iridate ($Na_2IrO_3$), potassium iridate ($K_2IrO_3$), and potassium ruthenate ($K_2RuO_4$).

In some embodiments, the counter electrode 114 comprises a substrate comprising a different material than the at least one platinum group metal or the at least one precious metal, and the substrate may be coated with the material of the counter electrode 114. The counter electrode 114 (either as a monolithic material or a coating over another material) may be substantially inert in the electrochemical cell 102. The counter electrode 114 may be formulated to resist attack from the molten salt electrolyte 110, which may be corrosive at high temperatures (e.g., greater than about 600° C., greater than about 800° C., etc.) under oxidizing conditions. The counter electrode 114 may exhibit high electrical conductivity suitable for operation in the electrochemical cell 102. Accordingly, the material of the counter electrode 114 may not be consumed during the electrochemical reduction reaction.

Figure 2:
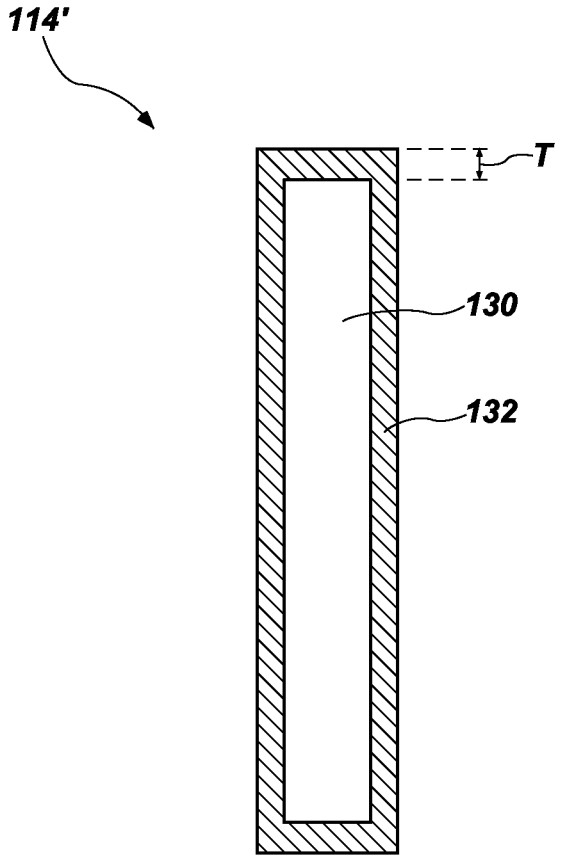
FIG. 2 is a simplified cross-sectional view of an anode that may be used in the electrochemical cell of FIG. 1.

FIG. 2 is a simplified cross-sectional view of a counter electrode 114', in accordance with some embodiments of the disclosure. The counter electrode 114' may comprise a substrate (e.g., a core) 130 and a coating material 132. The coating material 132 may include one or more of the materials described above with reference to the counter electrode 114 of FIG. 1. For example, the coating material 132 may comprise ruthenium, osmium, rhodium, iridium, palladium, platinum, silver, gold, lithium iridate, lithium ruthenate, a lithium rhodate, a lithium tin oxygen compound, a lithium manganese compound, calcium ruthenate, a strontium ruthenium ternary compound, calcium iridate, strontium iridate, calcium platinate, strontium platinate, magnesium ruthenate, magnesium iridate, sodium ruthenate, sodium iridate, potassium iridate, potassium ruthenate, or combinations thereof.

The coating material 132 may be substantially uniform over surfaces of the substrate 130. The coating material 132 may have a thickness T between about 1.0 mm and about 7.0 mm, such as between about 1.0 mm and about 3.0 mm, between about 3.0 mm and about 5.0 mm, or between about 5.0 mm and about 7.0 mm.

As noted above, the substrate 130 may comprise a material that is different than the coating material 132, and may comprise a metal or a non-metal. The substrate 130 may be selected to exhibit a coefficient of thermal expansion substantially similar to a coefficient of thermal expansion of the coating material 132. By way of non-limiting example, the substrate 130 may comprise graphite (e.g., high density graphite), nickel, molybdenum, tantalum, chromium, tungsten, titanium, or another material. In some embodiments, the substrate 130 comprises high density graphite.

The working electrode 116 may comprise a metal, such as iron, nickel, cobalt, etc., that can act as a current carrier and/or a source of material to be alloyed in the electrochemical cell 102. In some embodiments, the working electrode 116 consists essentially of the metal. For example, the working electrode 116 may include a nickel wire.

The reference electrode 118, if present, may be in electrical communication with the counter electrode 114 and the working electrode 116 and may be configured to assist in monitoring the potential difference between the counter electrode 114 and the working electrode 116. Accordingly, the reference electrode 118 may be configured to monitor the cell potential of the electrochemical cell 102.

The reference electrode 118 may include nickel, nickel/nickel oxide, glassy carbon, silver/silver chloride, one or more platinum group metals, one or more precious metals (e.g., gold), or combinations thereof. In some embodiments, the reference electrode 118 comprises glassy carbon. In other embodiments, the reference electrode 118 comprises nickel, nickel oxide, or a combination thereof. In yet other embodiments, the reference electrode 118 comprises silver/silver chloride.

A potentiostat 124 may be electrically coupled to each of the counter electrode 114, the working electrode 116, and the reference electrode 118. The potentiostat 124 may be configured to measure and/or provide an electric potential between the counter electrode 114 and the working electrode 116. The difference between the electric potential of the counter electrode 114 and the electric potential of the working electrode 116 may be referred to as a cell potential of the electrochemical cell 102.

The system 100 may be configured to reduce one or more metal oxides 126 to a metal alloy. In some embodiments, the metal oxides 126 may be in a powder form, or may be pressed into cohesive pellets. The working electrode 116 may be in electrical communication with a wire basket 120 configured to carry the metal oxides 126 to be reduced in the electrochemical cell 102. The wire basket 120 may comprise nickel, cobalt, iron, molybdenum, stainless steel, alloys of nickel and copper, alloys of nickel, chromium, iron, and molybdenum, alloys of nickel, iron, and molybdenum, another material, or combinations thereof. In some embodiments, the wire basket 120 comprises nickel.

The one or more metal oxides 126 may be in electrical contact with the working electrode 116, either directly or via the wire basket 120. The metal oxides 126 may be submersed in the molten salt electrolyte 110. The metal oxides 126 may include oxides of metals that may be used to form permanent magnets, such as $Sm_2O_3$, CoO, $Co_2O_3$, $Co_3O_4$, NiO, $Ni_2O_3$, $Fe_2O_3$, $Nd_2O_3$, etc.

The electrochemical cell 102 may optionally be contained within a gas-tight enclosure 104, which may include an inlet 106 and an outlet 108. The inlet 106 is configured for providing, for example, a gas to the enclosure 104 for maintaining a gas pressure within the enclosure 104. Gases may be removed from the enclosure 104 via the outlet 108. In some embodiments, the gas comprises an inert gas, such as argon, helium, or a combination thereof. The enclosure 104 may include a furnace or other heating element for heating or maintaining a temperature of a molten salt electrolyte 110 in the electrochemical cell 102. Although FIG. 1 illustrates that the enclosure 104 includes the inlet 106 and the outlet 108, the disclosure is not so limited. In other embodiments, the enclosure 104 may be configured as a so-called "glove box" wherein the enclosure is configured as a closed system. Thus, the inlet 106 and an outlet 108 may be connected to valves that are closed during operation of the electrochemical cell 102.

The molten salt electrolyte 110 may facilitate reduction of the metal oxides 126. In some embodiments, the metal oxides 126 may be reduced at the working electrode 116 (the cathode), according to Equation (1) below:

$$M_yO_x(s)+ze^-\rightarrow yM+z/xO^{2-} \quad (1),$$

wherein M is a metal (e.g., Ni, Co, Sm, etc.), $M_yO_x$ is the metal oxide, x is the stoichiometric amount of oxygen for the particular metal oxide, y is the stoichiometric amount of the metal in the metal oxide, and z is the stoichiometric amount of electrons for balancing the chemical reaction. The electrons are provided in the electrochemical cell 102 by provision of current to the working electrode 116, such as through the potentiostat 124.

The oxide ions generated at the working electrode 116 may be transported from the working electrode 116 to the counter electrode 114 responsive to exposure to the applied electrical field (i.e., a polarization between the counter electrode 114 and the working electrode 116, provided by the potentiostat 124). The oxide ions may be oxidized at the counter electrode 114 according to Equation (2) below:

$$2O^{2-}\rightarrow O_2(g)+4e^- \quad (2).$$

The oxygen gas generated at the counter electrode 114 may be evolved at the counter electrode 114. The electrons may be returned to the working electrode 116 surface.

In use and operation, the metal oxides 126 may be disposed in the electrochemical cell 102 and in contact with the molten salt electrolyte 110. An electric potential may be applied between the counter electrode 114 and the working electrode 116, providing a polarization field and a driving force for moving oxide ions dissolved from the metal oxide at the working electrode 116 to the counter electrode 114, facilitating reduction of the metal oxide at the working electrode 116.

The electric potential applied between the counter electrode 114 and the working electrode 116 may codeposit at least two metals by reduction of the metal oxides 126. For example, the applied electric potential may be between about 0.1 V and about 3.2 V. The composition may cause alloying of the metals to form a metal alloy powder. In some embodiments, metal of the working electrode 116 may also be alloyed with metals deposited by the electrical potential.

The composition of the metal alloy powder formed in the electrochemical cell 102 may vary based on the composition of the metal oxides 126. For example, if the metal oxides 126 include nickel oxide and cobalt oxide, the resulting metal alloy powder may have a molar ratio of nickel to cobalt approximately the same as the molar ratio of nickel and cobalt in the metal oxides 126. Thus, the metal alloy powder may be formed with any selected ratio of nickel to cobalt, even nickel-rich alloys that may be difficult to form by conventional electrochemical processes. If the metal oxides 126 include samarium oxide and cobalt oxide, the resulting metal alloy powder may have a molar ratio of samarium to cobalt approximately the same as the molar ratio of samarium and cobalt in the metal oxides 126. The ratio of samarium to cobalt in the metal oxides 126 may lead to different SmCo phases in the metal alloy powder. For example, the metal alloy powder may include $SmCo_2$, $SmCo_3$, $SmCo_5$, $Sm_2Co_7$, or $Sm_2Co_{17}$.

In some embodiments, the metal alloy powder may include a metal of the working electrode 116 in addition to or instead of one or more of the metals of the metal oxides 126. For example, if the metal oxides 126 include $Sm_2O_3$ and CoO, and the working electrode 116 includes nickel, the resulting alloy powder may include Sm, Co, and Ni. Without being bound to any particular theory, the nickel of the working electrode 116 may act as both a current collector and a source of metal.

The metal alloy powder formed in the electrochemical cell 102 may be used to form a composite and/or hybrid magnet by any means known in the art. For example, the metal alloy powder may be pressed in a die, subjected to a magnetic field, sintered in the magnetic field, and tempered. Such processes are described in U.S. Pat. No. 4,075,042, "Samarium-cobalt magnet with grain growth inhibited $SmCo_5$ crystals," issued Feb. 21, 1978, the entire disclosure of which is hereby incorporated herein by reference.

It appears that the deposition methods described herein have significant advantages over conventional aqueous electrochemical processes for the preparation of nickel-cobalt alloy powder. The methods described do not appear to suffer from anomalous co-deposition resulting in a cobalt-rich alloy powder, which is a long-standing as well as unsolved technical problem in the art. Furthermore, the methods use relatively inexpensive and abundant oxides, and appear to be more energy-efficient than conventional methods (e.g., due to lower electrical energy input).

The processes described herein appear to be versatile not only for preparing NiCo—SmCo composite magnets but for synthesizing the individual magnets (NiCo and SmCo respectively) from their mixed oxides. Further, it appears that composite magnet powders may be formed having either a combination of soft (nickel-rich NiCe) and hard (SmCo) characteristics or a permanent magnet containing cobalt-rich NiCo and SmCo phases. Upon prolonged polarization it may be possible to synthesize various SmCo phases (such as $Sm_2Co_{17}$, $SmCo_5$, $Sm_2Co_7$, $SmCo_3$, and $SmCo_2$). Also, by either placing a sintered pellet in a crucible or using cobalt as a current collector, it may be possible to synthesize pure SmCo magnets directly from mixed oxides. Similarly, by varying the reduction parameters, it may be possible to prepare either a soft or a hard NiCo magnet powder. The phase composition of the reduced alloy may be tailored to make different grades of composite magnets. Sintering the mixed oxide precursor in a reducing atmosphere prior to electrolysis may decrease the overall duration of the reduction reaction. By way of non-limiting example, the mixed oxide precursor may be sintered in a reducing atmosphere consisting of argon with 2.8 vol. % hydrogen ($H_2$) at a temperature of greater than 1000° C., such as between about 1000° C. and 1400° C. The duration of the reducing reaction after sintering in the foregoing reducing atmosphere may be in a range from about 1 to about 3 hours, which is less than the duration of the reducing reaction after sintering in air for the pellet compositions described in Examples 3 and 4 below. Without being bound to any particular theory, sintering in a reducing environment is believed to induce the formation of non-stoichiometric type defects and porosity into the otherwise stoichiometric oxides of the pellet. Further, sintering in the reducing environment is believed to be most effective for strong hydride-forming elements, such as neodymium and samarium, as compared to other elements such as cobalt or nickel.

Furthermore, the processes described herein may be used for preparing other magnets. For example, substitution of FeCo or FeNi for the NiCo in the process described above may yield an alloy of FeCo—SmCo or FeNi—SmCo, respectively.

On account of high manufacturing costs, SmCo-based magnets are not a large part of total magnet production. The processes described herein may be used as low-cost methods for forming composite magnets containing SmCo magnetic phases. Such approaches can also be used to prepare other alloys, such as NdFeB-based composite magnets.

EXAMPLE 1

Nickel-Cobalt Alloy

An electrolyte comprising high-purity anhydrous calcium chloride was prepared. Calcium oxide was added to the electrolyte such that the calcium oxide constituted about 1.0 wt % of the electrolyte. The electrolyte was melted in an alumina crucible inside a glove box under an argon atmosphere having less than 0.1 parts per million (ppm) each of moisture and oxygen. An anode was placed in the electrolyte, comprising a monolithic ruthenium rod having a diameter of 3 mm, a length of 100 mm, and a purity of 99.9%. A reference electrode was placed in the electrolyte, comprising glassy carbon having a diameter of 3 mm and a length of 100 mm. A nickel wire, having a diameter of 3 mm and a purity of 99.9%, in combination with a mixture of NiO and CoO powders in a wire basket, formed the cathode. The electrodes were sheathed with high purity alumina tubes to insulate them from electrically conductive parts of the electrochemical cell.

The temperature of the electrolyte was set at 850° C., and the measured temperature, during electrodeposition tests, was observed to be 850±2° C. The melt was allowed to homogenize, for about an hour, prior to the electrochemical reduction. The electrodes were lowered into the melt, and the electrical connections were made through a potentiostat-galvanostat in order to record the experimental data.

The electrochemical reduction was carried out at constant voltage. The current spiked for a very short time before registering a smooth decline. After a period of about 5 hours, the furnace was switched off and cooled to room temperature. The alloy was then washed with water to remove adherent salt (calcium chloride). The powdered alloy was finally washed with acetone and dried in an oven. The dried powder was further evaluated and characterized by XRD (X-ray diffraction) and SEM-EDS (scanning electron microscopy-energy dispersive spectroscopy). XRD analysis of the dried powder indicated the presence of NiCo, as well as trace amounts of $SmCo_2$. The reduced samples were also evaluated and characterized by powder. XRD and SEM-EDS techniques.

The alloy powder, like any other electrochemically reduced alloy, appeared inhomogeneous. EDS analysis, at different points of the powder, suggested a significant reduction in cobalt content, which is difficult to form by conventional aqueous electrochemistry. The alloy powder was observed to be strongly attracted by a neodymium-iron-boron magnet.

The residual oxygen content of the metal oxide was measured using an elemental analyzer available from LECO Corporation, of Saint Joseph, Missouri. The metal oxide was reduced by about 98.9%. In other words, after the electrochemical reaction, the metal oxide had less than about 2,000 ppm oxygen, indicating a reduction in oxygen content of about 98.9%. Stated another way, the metal oxide was reduced and included about 0.2 wt % oxygen.

The counter electrode (anode) was visually inspected for mechanical degradation such as cracking, thinning, spalling, corrosion, erosion, or necking. No mechanical degradation was observed in the anode.

EXAMPLE 2

Iron-Cobalt-Nickel Alloy

Powders of $Fe_2O_3$, CoO, and NiO were mixed in a molar ratio of 1 mole $Fe_2O_3$ to 2 moles of CoO and 2 moles NiO and the mixed powder was mixed with polyethyelene glycol and poly vinyl alcohol and, subsequently, with isopropanol to form a homogeneous slurry. The liquid (isopropanol) was allowed to evaporate from the slurry overnight. The thoroughly mixed powder was then subjected to pelletization in a laboratory hydraulic laboratory press under a pressure of between 50 and 70 MPa to form the green pellets. The green pellets were sintered in air at 1,000° for a duration of up to 3 hours. The sintered pellet was then threaded onto a wire, such as a nickel wire, having a diameter of 3 mm. The assembly was immersed in a calcium chloride-calcium oxide electrolyte, as described in Example 1. The immersed sintered pellet was cathodically polarized against a monolithic platinum group metal rod (both ruthenium and iridium, 3 mm diameter and 100 mm long), were used as the counter electrode (anode). A glassy carbon rod (3 mm diameter and 100 mm long) was used as a reference electrode. The electrodes were lowered into the electrolyte melt, and the electrical connections were made through a potentiostat in order to record the experimental data.

The electrochemical reduction was carried out at a constant voltage of up to 3.1 V for a duration of between 5 and 10 hours. The temperature of the electrolyte melt was set to between 850° C. and 950° C. (±2° C.).

The reduced pellets were evaluated and characterized to determine phase and elemental compositions using XRD and/or EDS and to evaluate magnetic properties. The analysis indicated the major phase in the reduced pellets was FeCoNi and the minor phases were FeCo, CoNi, and FeN. The elemental analysis indicated that the content of oxygen was reduced from an initial value of 25.4 wt % to less than 0.2 wt %. The total metal content of the reduced pellet rose from an initial value of 74.63 wt % to more than 99.5 wt %. The sintered mixed oxide pellet did not exhibit any magnetic behavior prior to the electwchemical reduction. The reduced pellet, however, was observed to be strongly attracted by a neodymium iron boron magnet.

EXAMPLE 3

Samarium-Cobalt Alloy

High purity (99.9% pure) and relatively fine (about 1 μm mean diameter) oxide powders of $Sm_2O_3$ and CoO were mixed in a molar ratio of 1 mole $Sm_2O_3$ to 5 moles CoO, and the mixed oxide powder was homogenized in an agate pestle mortar with poly vinyl alcohol (1.75% of the total mixed oxide charge and 5-6 drops of polyethyelene glycol as the binders). The mixed oxide powder with binder was subjected to pelletization in a laboratory hydraulic press under a pressure of 64 MPa to form green pellets. Two groups of green pellets were sintered in air at 1,300° C. for durations of 1 hour and 3 hours, respectively. The sintered oxide pellets were then threaded onto nickel wire having a diameter of 3 mm. Each assembly was separately immersed in a calcium chloride-calcium oxide electrolyte, as described in Example 1. Each immersed oxide pellet was cathodically polarized against a monolithic platinum group metal rod (ruthenium, iridium or platinum, 3 mm diameter and 100 mm long) as the counter electrode (anode). A glassy carbon rod (3 mm diameter and 100 mm long) was used as a reference electrode. The polarization was performed in an atmosphere-controlled glove box under argon, with 1 ppm water and 2-3 ppm oxygen, at an applied cell voltage in the range 2.8 to 3.2 V, for durations up to about 5 hours to form a reduced powder. The resulting reduced powder was soaked in ethyl alcohol and then washed with deionized water to remove excess or associated calcium chloride. The phase composition and morphology of the sintered (i.e., unreduced) pellets as well as the reduced powder were examined by XRD and SEM-EDS techniques.

XRD results indicated the presence of CoO, $Sm_2CoO_4$, $SmCoO_5$, and $Co_3O_4$ phases in the sintered pellets. No $Sm_2O_3$ was detected in the XRD profile. The sintered pellets underwent reductions in weight (2.7%), diameter (4.1%), and thickness (1.1%) during sintering. The percentage open porosity was determined to be 24.4% in the sintered pellets. Presence of some degree of open porosity appears to facilitate removal of oxygen ions from the oxide matrix to the electrolyte upon polarization.

Electrolysis was carried out at constant voltage. When the current started declining at a particular voltage, the cell voltage was raised incrementally from 2.5 V to 3.1 V. The incremental increase in the cell voltage resulted in a temporary rise in the current. At a relatively lower voltage, CoO appeared to be reduced first. The reduction of $Sm_2O_3$ took place at a later stage. Because the nickel wire was in direct contact with the oxide pellet, nickel appeared to alloy with the cobalt in situ. The reduced alloy powder formed, after cleaning, was observed to contain two binary (major) phases: NiCo and $SmCo_2$. The alloy powder was observed to be strongly attracted by a neodymium (e.g., neodymium-iron-boron, NdFeB) magnet. SEM-EDS photographs indicated distinct zones, some rich with a NiCo phase and others rich with a $SmCo_2$ phase.

EXAMPLE 4

Neodymium-Iron Alloy

High purity (99.9% pure) neodymium (III) oxide ($Nd_2O_3$) and iron (III) oxide ($Fe_2O_3$) were mixed in a 1:1 molar ratio to form a mixed oxide powder. High purity (99.9% pure) polyethylene glycol (PEG) and polyvinyl alcohol (PVA) were mixed with the mixed oxide powder. Isopropyl alcohol was added to the mixed oxide powder to form a slurry. The slurry was compacted in a stainless steel die to form a pellet having a diameter of 13 mm. The pellet was subsequently fired in air to provide adequate strength to maintain form during electrochemical reduction.

The pellet was immersed in a calcium chloride-calcium oxide electrolyte, as described in Example 1. The immersed pellet was cathodically polarized against monolithic platinum group metal rods (one each of ruthenium and iridium, each 3 mm diameter and 100 mm long) as the counter electrode (anode). A glassy carbon rod (9 mm diameter and 100 mm long) was used as a reference electrode. The polarization experiments were performed in an atmosphere-controlled glove box under argon, with less than 1 ppm water and less than 10 ppm oxygen. The resulting reduced powders were soaked in ethyl alcohol and then washed with deionized water to remove excess or associated calcium chloride. The phase composition and morphology of the sintered (i.e., unreduced) pellets as well as the reduced powders were examined by XRD and SEM-EDS techniques.

The major phases in the sintered pellets before electrolysis were $NdFeO_3$ and $Fe_2O_3$. The $Nd_2O_3$ appears to have reacted with $Fe_2O_3$ to form the ternary oxide ($NdFeO_3$). A trace of $Nd(OH)_3$, was also detected, which may have formed during the mixing of the powder with isopropyl alcohol.

The sintered pellets underwent reductions in weight (4%), diameter (12%), and thickness (10.5%) during sintering. The percentage open porosity was determined to be 18.8% in the sintered pellets. The sintered oxide pellets were observed to possess sufficient mechanical integrity to subject them to subsequent electrochemical reduction studies, and to drill a hole in the center to facilitate connection to a nickel wire current collector.

Possible reduction paths were studied by removing the pellets from the cell, from time to time, and analyzing the phase composition by XRD. As expected, metallic iron was found during early stages of the reduction (within about 5 hours), which was followed up by the formation of traces of neodymium. Significant amounts of neodymium oxychloride (NdOCl) were observed within the first 10 hours of reduction. The product phase did not contain any NdOCl phase upon prolonged electrolysis (at least 24 hours).

The electrolysis was carried out at constant voltage over 24 hours. Initially, the current spiked up to about 3.2 A, then shortly thereafter, the current fell to about 2.5 A. The cell voltage was in the range from about 2.1 V to about 3.0 V during the first 16 hours, and in the range from about 2.5 V to about 3.0 V for the next 8 hours. The reduction reaction was terminated after 24 hours. The color of the pellet changed from grey to brick-red during electrolysis. The reduced alloy was observed to maintain its mechanical integrity, with some shrinkage in its diameter and thickness even after soaking in ethyl alcohol.

The reduced alloy was observed to be strongly attracted to a permanent magnet, presumably because of the presence of free iron. The chemical assay of the alloy indicated 61.3 wt % neodymium, 24 wt % iron, 10 wt % calcium, 2.5 wt % oxygen, 1.5 wt % chlorine, and 0.7 wt % aluminum.

Additional non limiting example embodiments of the disclosure are described below.

Embodiment 1: A method of forming an alloy comprising disposing a first metal oxide and a second metal oxide in a molten salt. The molten salt is in contact with a working electrode and a counter electrode. An electrical potential is applied between the counter electrode and the working electrode to co-reduce the first metal oxide and the second metal oxide to form a first metal and a second metal, respectively.

Embodiment 2: The method of Embodiment 1, further comprising selecting the counter electrode to comprise a platinum-group metal.

Embodiment 3: The method of Embodiment 2, further comprising selecting the counter electrode to comprise the platinum-group metal over a base material.

Embodiment 4: The method of any of Embodiments 1 through 3, wherein disposing the first metal oxide and the second metal oxide in the molten salt comprises disposing $Sm_2O_3$ in the molten salt.

Embodiment 5: The method of any of Embodiments 1 through 4, wherein disposing the first metal oxide and the second metal oxide in the molten salt comprises disposing CoO in the molten salt.

Embodiment 6: The method of any of Embodiments 1 through 5, wherein disposing the first metal oxide and the second metal oxide in the molten salt comprises disposing NiO in the molten salt.

Embodiment 7: The method of any of Embodiments 1 through 6, wherein disposing the first metal oxide and the second metal oxide in the molten salt comprises disposing $Nd_2O_3$ in the molten salt.

Embodiment 8: The method of any of Embodiments 1 through 7, wherein disposing the first metal oxide and the second metal oxide in the molten salt comprises disposing $Fe_2O_3$ in the molten salt.

Embodiment 9: The method of any of Embodiments 1 through 8, wherein disposing the first metal oxide and the second metal oxide in the molten salt comprises maintaining the molten salt at a temperature of at least 750° C.

Embodiment 10: The method of any of Embodiments 1 through 9, wherein applying the electrical potential between the counter electrode and the working electrode comprises maintaining the molten salt under an inert atmosphere.

Embodiment 11: The method of Embodiment 10, wherein maintaining the molten salt under the inert atmosphere comprises maintaining the molten salt under an atmosphere consisting essentially of argon.

Embodiment 12: The method of any of Embodiments 1 through 11, further comprising disposing a reference electrode in contact with the molten salt.

Embodiment 13: The method of Embodiment 12, further comprising selecting the reference electrode to comprise glassy carbon.

Embodiment 14: The method of any of Embodiments 1 through 13, further comprising selecting the working electrode to comprise nickel.

Embodiment 15: The method of any of Embodiments 1 through 14, further comprising selecting the molten salt to comprise calcium chloride.

Embodiment 16: The method of any of Embodiments 1 through 15, wherein applying an electrical potential between the counter electrode and the working electrode comprises forming a nickel-rich alloy.

Embodiment 17: The method of any of Embodiments 1 through 16, wherein applying an electrical potential between the counter electrode and the working electrode comprises transferring a metal from the working electrode to the alloy.

Embodiment 18: A method of reducing metal oxides, the method comprising providing an electrochemical cell comprising a working electrode, a counter electrode comprising a platinum-group metal, and a molten salt in contact with the working electrode and the counter electrode; disposing a material comprising at least two metal oxides in contact with the molten salt and the working electrode; and providing an electric current between the counter electrode and the working electrode to reduce the at least two metal oxides to form an alloy comprising at least two metals formed by reduction of the at least two metal oxides.

Embodiment 19: The method of Embodiment 18, further comprising selecting the counter electrode to comprise a metal selected from the group consisting of iridium, ruthenium, and platinum.

Embodiment 20: The method of Embodiment 18 or Embodiment 19, further comprising selecting the counter electrode to comprise a substrate material selected from the group consisting of high-density graphite, molybdenum, tantalum, titanium, nickel, chromium, tungsten, and combinations thereof, wherein the substrate material is coated with the platinum-group metal.

Embodiment 21: The method of any of Embodiments 18 through 20, further comprising selecting the counter electrode to comprise a substrate material coated with a coating material comprising the platinum-group metal and having a thickness between about 3.0 mm and about 5.0 mm.

Embodiment 22: The method of any of Embodiments 18 through 21, further comprising selecting the working electrode to comprise nickel.

Embodiment 23: The method of any of Embodiments 18 through 22, further comprising selecting the molten salt to comprise calcium chloride.

Embodiment 24: The method of any of Embodiments 18 through 23, wherein disposing a material comprising at least two metal oxides in contact with the molten salt and the working electrode comprises disposing cobalt oxide in contact with the molten salt and the working electrode.

Embodiment 25: The method of any of Embodiments 18 through 24, wherein disposing a material comprising at least two metal oxides in contact with the molten salt and the working electrode comprises disposing samarium oxide in contact with the molten salt and the working electrode.

Embodiment 26: The method of any of Embodiments 18 through 25, wherein disposing a material comprising at least two metal oxides in contact with the molten salt and the working electrode comprises disposing nickel oxide in contact with the molten salt and the working electrode.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. In addition, features from one embodiment may be combined with features of another embodiment while still being encompassed within the scope of the disclosure as contemplated. Further, embodiments of the disclosure have utility with different and various alloy types and formulations.

What is claimed is:

1. A method of forming an alloy, the method comprising:

disposing a first metal oxide comprising cobalt oxide and a second metal oxide comprising nickel oxide in a molten salt, the molten salt in contact with a working electrode comprising nickel and a counter electrode; and applying an electrical potential between the counter electrode and the working electrode to co-reduce the first metal oxide and the second metal oxide to form a cobalt-nickel alloy.

2. The method of claim 1, further comprising selecting the counter electrode to comprise ruthenium, lithium iridate, lithium ruthenate, a lithium rhodate, a lithium tin oxygen, a lithium manganese oxygen compound, calcium ruthenate, strontium ruthenium ternary compounds, calcium iridium oxide, strontium iridate, calcium platinate, strontium platinate, magnesium ruthenate, magnesium iridate, sodium ruthenate, sodium iridate, potassium iridate, or potassium ruthenate.

3. The method of claim 2, further comprising selecting the counter electrode to comprise the ruthenium, lithium iridate, lithium ruthenate, a lithium rhodate, a lithium tin oxygen, a lithium manganese oxygen compound, calcium ruthenate, strontium ruthenium ternary compounds, calcium iridium oxide, strontium iridate, calcium platinate, strontium platinate, magnesium ruthenate, magnesium iridate, sodium ruthenate, sodium iridate, potassium iridate, or potassium ruthenate over a base material.

4. The method of claim 1, further comprising maintaining the molten salt at a temperature of at least 750° C.

5. The method of claim 1, wherein applying the electrical potential between the counter electrode and the working electrode comprises maintaining the molten salt under an inert atmosphere.

6. The method of claim 5, wherein maintaining the molten salt under the inert atmosphere comprises maintaining the molten salt under an atmosphere consisting essentially of argon.

7. The method of claim 1, further comprising disposing a reference electrode in contact with the molten salt.

8. The method of claim 1, further comprising selecting the molten salt to comprise one of potassium chloride, potassium bromide, cesium bromide, calcium bromide, or strontium bromide.

9. A method of forming an alloy, the method comprising:

disposing a first metal oxide and a second metal oxide in a molten salt, the molten salt in contact with a working electrode and a counter electrode, the working electrode comprising a metal selected from the group consisting of iron, nickel, cobalt, and combinations thereof; and applying an electrical potential between the counter electrode and the working electrode to co-reduce the first metal oxide and the second metal oxide to form a nickel-rich alloy of the first metal and the second metal.

10. The method of claim 9, wherein applying an electrical potential between the counter electrode and the working electrode comprises transferring a metal from the working electrode to the alloy, the working electrode consisting essentially of the metal.

11. A method of reducing metal oxides, the method comprising:

providing an electrochemical cell comprising a working electrode, a counter electrode comprising a platinum-group metal, and a molten salt in contact with the working electrode and the counter electrode;

disposing a material comprising at least two metal oxides in contact with the molten salt and the working electrode, one of the at least two metal oxides comprising nickel oxide; and providing an electric current between the counter electrode and the working electrode to reduce the at least two metal oxides to form an alloy comprising at least two metals formed by reduction, the alloy comprising a nickel-cobalt alloy, a samarium-cobalt alloy, or an iron-cobalt-nickel alloy.

12. The method of claim 11, further comprising selecting the counter electrode to comprise a metal selected from the group consisting of iridium, ruthenium, and platinum.

13. The method of claim 11, further comprising selecting the counter electrode to comprise a substrate material selected from the group consisting of high-density graphite, molybdenum, tantalum, titanium, nickel, chromium, tungsten, and combinations thereof, wherein the substrate material is coated with the platinum-group metal.

14. The method of claim 11, further comprising selecting the counter electrode to comprise a substrate material coated with a coating material comprising the platinum-group metal and having a thickness between about 3.0 mm and about 5.0 mm.

15. The method of claim 11, further comprising selecting the working electrode to consist essentially of nickel.

16. The method of claim 1, wherein the working electrode consists essentially of nickel, and wherein applying an electrical potential between the counter electrode and the working electrode to co-reduce the first metal oxide and the second metal oxide to form a cobalt-nickel alloy further comprises alloying nickel from the working electrode to form the cobalt-nickel alloy.

17. The method of claim 1, wherein applying an electrical potential between the counter electrode and the working electrode to form a cobalt-nickel alloy comprises forming the cobalt-nickel alloy comprising a molar ratio of cobalt to nickel that is substantially the same as a molar ratio of the cobalt oxide to nickel oxide.

18. The method of claim 9, wherein applying an electrical potential between the counter electrode and the working electrode to co-reduce the first metal oxide and the second metal oxide to form a nickel-rich alloy of the first metal and the second metal comprises forming a nickel-rich cobalt-nickel alloy.

19. The method of claim 11, further comprising:

selecting the working electrode to consist essentially of a metal; and alloying the metal of the working electrode with the alloy comprising the at least two metals formed by reduction.

20. The method of claim 11, wherein providing an electrochemical cell comprising a working electrode, a counter electrode comprising a platinum-group metal, and a molten salt comprises selecting the working electrode to consist essentially of cobalt.

* * * * *